US010063988B2

(12) United States Patent
Muench et al.

(10) Patent No.: US 10,063,988 B2
(45) Date of Patent: Aug. 28, 2018

(54) VEHICLE SOUND PROCESSING SYSTEM

(71) Applicant: Harman Becker Automotive Systems GmbH, Karlsbad (DE)

(72) Inventors: Tobias Muench, Munich (DE); Kevin Eric Heber, Carmel, IN (US)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 15/803,910

(22) Filed: Nov. 6, 2017

(65) Prior Publication Data

US 2018/0132052 A1 May 10, 2018

(30) Foreign Application Priority Data

Nov. 8, 2016 (EP) ..... 16197662

(51) Int. Cl.
*H04S 7/00* (2006.01)
*H04R 5/02* (2006.01)
(Continued)

(52) U.S. Cl.
CPC ..... *H04S 7/303* (2013.01); *H04R 1/406* (2013.01); *H04R 3/005* (2013.01); *H04R 5/02* (2013.01);
(Continued)

(58) Field of Classification Search
CPC ..... H04S 7/303; H04S 3/008; H04R 1/406; H04R 5/02; H04R 3/005
See application file for complete search history.

(56) References Cited

U.S. PATENT DOCUMENTS

2006/0001532 A1 1/2006 Nagata
2010/0033313 A1* 2/2010 Keady ..... G08G 1/0965 340/438
(Continued)

FOREIGN PATENT DOCUMENTS

EP 2011711 A1 1/2009
EP 2876639 A2 5/2015

OTHER PUBLICATIONS

Geiger et al., "Large-Scale Audio Feature Extraction and SVM for Acoustic Scene Classifications", 2013 IEEE Workshop on Application of Signal Processing to Audio and Acoustics, Oct. 20-23, 2013, New Paltz, NY, 4 pages. Imoto et al., "Spatial-Feature-Based Acoustic Scene Analysis Using Distributed Microphone Array", 2015, IEEE, 23rd European Signal Processing Conference, pp. 739-743.

*Primary Examiner* — Mohammad Islam
(74) *Attorney, Agent, or Firm* — Brooks Kushman P.C.

(57) ABSTRACT

A vehicle sound processing system including an array of sensors, memory, and a processing unit. The array of sensors is configured to detect signals of an object located outside the vehicle. The memory is configured to store control instructions. The processing unit is connected to the array of sensors and configured to read the control instructions from the memory and to perform, based on the control instructions, the following steps: determining the location of the object outside the vehicle is based on the detected signals, generating a three-dimensional sound field inside the vehicle and a sound event representing the detected object is placed in the three-dimensional sound field at a virtual location in the three-dimensional sound field such that when the three-dimensional sound field with the sound event is output to a vehicle occupant, the vehicle occupant locates the sound event at the determined location of the object. Furthermore, a zoom function is provided with which a distance of the
(Continued)

virtual location of the sound event relative to the vehicle occupant is decreased or increased.

20 Claims, 5 Drawing Sheets

(51) Int. Cl.
*H04R 1/40* (2006.01)
*H04R 5/04* (2006.01)
*H04S 3/00* (2006.01)
*H04R 3/00* (2006.01)

(52) U.S. Cl.
CPC ..... *H04R 5/04* (2013.01); *H04S 3/008* (2013.01); *H04R 2499/13* (2013.01); *H04S 2400/11* (2013.01)

(56) References Cited

U.S. PATENT DOCUMENTS

2011/0133917 A1* 6/2011 Zeng ..... G06K 9/6293 340/436
2015/0025664 A1* 1/2015 Cory ..... H04S 7/30 700/94
2015/0304789 A1* 10/2015 Babayoff ..... H04R 1/403 381/303
2015/0336575 A1* 11/2015 Zeng ..... B62D 15/0265 701/41
2016/0003938 A1* 1/2016 Gazit ..... G01S 13/02 342/81
2016/0349363 A1* 12/2016 Millar ..... G01S 13/89
2017/0098452 A1* 4/2017 Tracey ..... G10L 19/20
2017/0245089 A1* 8/2017 Freimann ..... H04S 7/302
2018/0046431 A1* 2/2018 Thagadur Shivappa ..... G06F 3/165

* cited by examiner

VEHICLE SOUND PROCESSING SYSTEM

CROSS-REFERENCE TO RELATED APPLICATIONS

This application claims foreign priority benefits under 35 U.S.C. § 119(a)-(d) to EP Application Serial No. 16 197 662.6 filed Nov. 8, 2016, the disclosure of which is hereby incorporated in its entirety by reference herein.

FIELD OF THE INVENTION

The present application relates to a vehicle sound processing system and to a method for generating a three-dimensional sound field. Furthermore, a computer program comprising program code and a carrier are provided.

BACKGROUND

Motor vehicles like cars, trucks and the like increasingly use driver assistance systems, which assist a driver in driving the motor vehicle. Furthermore, vehicles are developed which should drive autonomously in the future. To this end, the vehicles use an array of sensors provided in the vehicle, which gather signals from the vehicle environment to determine objects located in the vehicle environment. Furthermore, it is expected that the vehicle cabin will be silent in the future due to the use of noise cancellation systems. Accordingly, the passengers or occupants inside the vehicle are acoustically isolated from the outside and little attention is paid to the actual driving process. Accordingly, it would be helpful to inform the vehicle occupant about certain events occurring outside the vehicle either based on input provided by the vehicle occupant or by the fact that the driving situation requires it. In this context, it would be especially helpful to provide a possibility to draw the vehicle occupant's attention to a certain object located outside the vehicle.

SUMMARY

According to a first aspect, a vehicle sound processing system is provided that includes an array of sensors configured to detect the signals of an object located outside the vehicle. Furthermore, the vehicle sound processing system includes a memory configured to store control instructions and a processing unit connected to the array of sensors and configured to read the control instructions from the memory. The processing unit is configured to perform, based on the control instructions, the step of determining the location of the object outside the vehicle based on the detected signals.

Furthermore, a three-dimensional sound field is generated inside the vehicle and a sound event representing the detected object is placed in the three-dimensional sound field at a virtual location in the three-dimensional sound field such that, when the three-dimensional sound field with the sound event is output to the vehicle occupant, the vehicle occupant locates the sound event at the determined location of the object. Furthermore, a zoom function is provided with which a distance of the virtual location of the sound event relative to the vehicle occupant is decreased or increased.

The vehicle sound processing system provides a possibility to generate a three-dimensional sound field inside the vehicle such that the listener's perception is that the sound of the object located outside the vehicle is coming from the position where the object is actually located. This can help to inform the driver of hazardous situations. With the zoom function, the vehicle occupant's attention can be drawn to this object outside the vehicle by providing the impression as if the object were located closer to the vehicle as in reality. The zoom function helps to emphasize a possible dangerous situation so that a vehicle occupant such as the driver can react accordingly. The zoom function may be controlled automatically by decreasing or increasing the distance at which the listener perceives the object, for example, by a predefined percentage of the actual distance. Furthermore, it is possible that a user actively controls the zoom function with an indication how the distance of the object in the sound field should be adapted.

Furthermore, the corresponding method for generating the three-dimensional sound field comprising the above-discussed steps is provided.

Additionally, a computer program comprising program code to be executed by the at least one processing unit of the vehicle sound processing system is provided. The execution of the program code causes the at least one processing unit to execute a method discussed above and discussed in more detail below. Additionally, a carrier comprising the computer program is provided.

It is to be understood that the features mentioned above and features yet to be explained below can be used not only in the respective combinations indicated, but also in other combinations or in isolation without departing from the scope of the present application. Features of the above-mentioned aspects may be combined with each other, unless explicitly mentioned otherwise.

BRIEF DESCRIPTION OF THE DRAWINGS

The foregoing and additional features and effects of the application will become apparent from the following detailed description when read in conjunction with the accompanying drawings in which like reference numerals refer to like elements.

DETAILED DESCRIPTION

Figure 1:
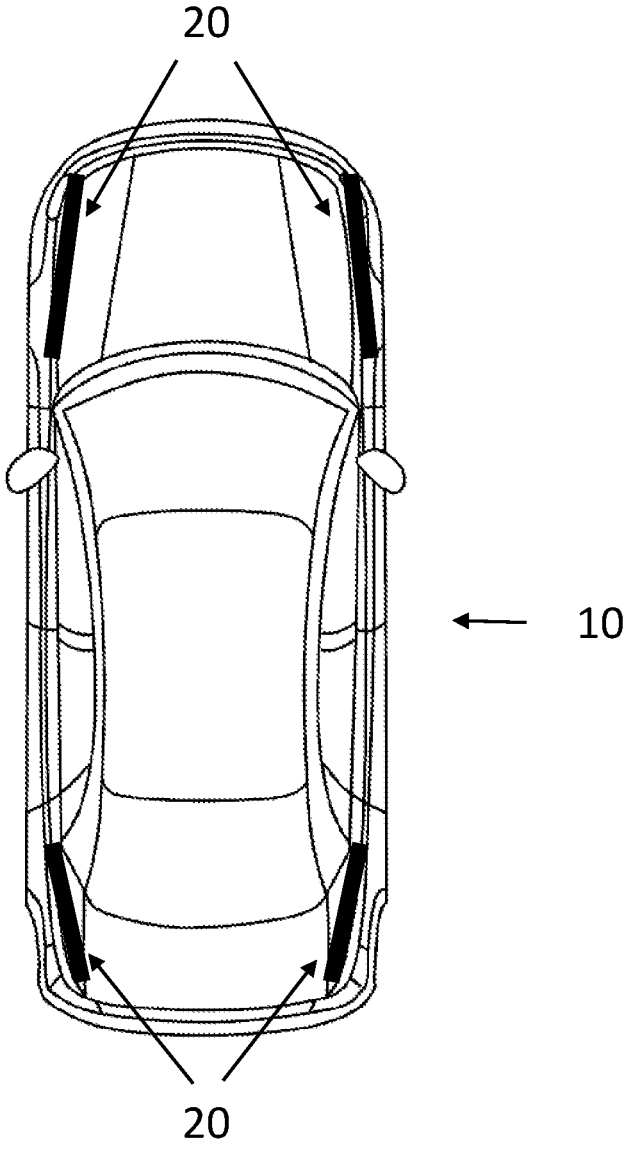
FIG. 1 shows a schematic view of a vehicle comprising an array of sensors detecting the vehicle environment.

In the following the application will be described with reference to the accompanying drawings. It is to be understood that the following description is not to be taken in a limiting sense. The scope of the application is not intended to be limited by the examples described hereinafter or by the drawings which are to be illustrative only.

The drawings are to be regarded as being schematic representations, and elements illustrated in the drawings are not necessarily shown to scale. Rather, the various elements are represented such that their function and general purpose becomes apparent to a person skilled in the art. Any connection or coupling between functional blocks, devices, components or physical or functional units shown in the drawings and described hereinafter may also be implemented by an indirect connection or coupling. A coupling between components may be established over a wired or wireless connection. Functional blocks may be implemented in hardware, software, firmware or a combination thereof.

FIG. 1 schematically shows a vehicle 10 comprising an array of sensors 20 provided on the vehicle 10 to monitor an environment and space outside of the vehicle 10. The array of sensors 20 can comprise an array of external microphones and/or an array of image sensors configured to take images from the vehicle environment. The sensor array 20 may furthermore comprise radar elements, lasers, PMD sensors or any other element with which a position of objects located outside the vehicle 10 can be determined.

Figure 2:
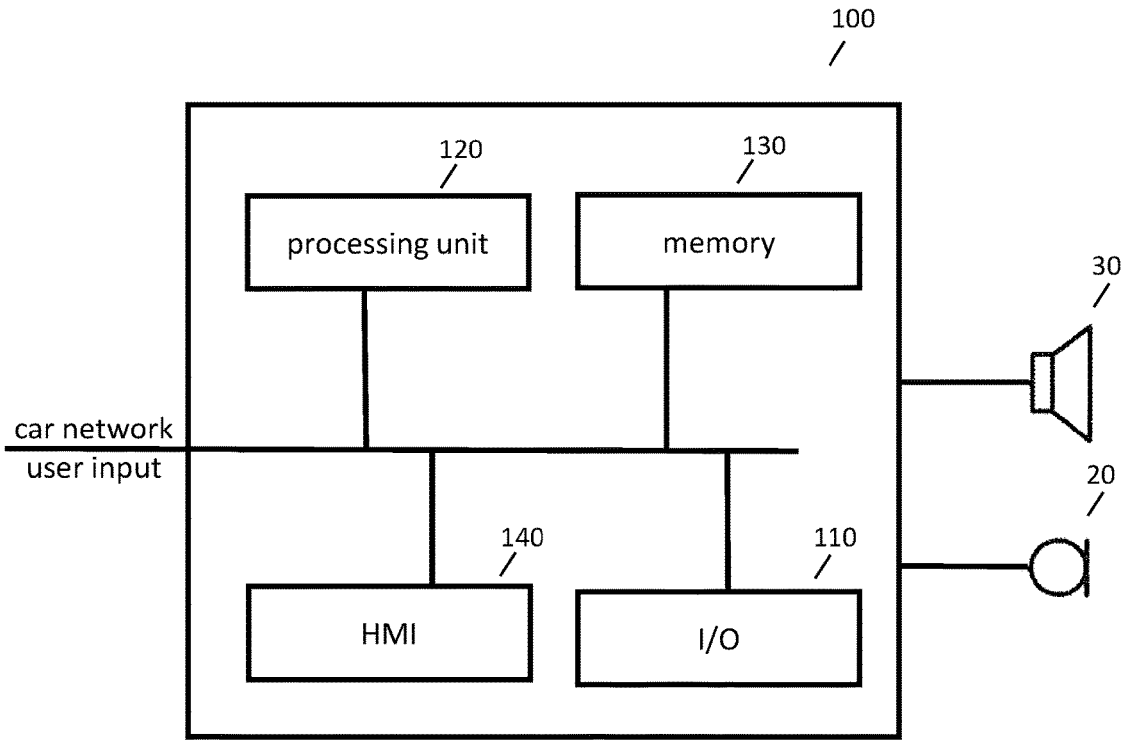
FIG. 2 shows an example schematic representation of a vehicle sound processing system configured to generate a three-dimensional sound field for the vehicle occupant.

FIG. 2 shows a more detailed view of a vehicle sound processing system 100 located in the vehicle 10. The sound processing system comprises an interface 110 which is provided for transmitting data or control messages to other entities inside or outside the vehicle using a wired or wireless transmission. By way of example, interface 110 is provided to receive sensor signals acquired by the array of sensors 20. Furthermore, a processing unit 120 is provided comprising one or more processors and which can carry out instructions stored on a memory 130, wherein the memory 130 may include a read-only memory, a random-access memory, a mass storage, a hard disk or the like. The memory 130 can furthermore include suitable program code to be executed by the processing unit 120 so as to implement the functionalities of the sound processing system 100 described above or described in more detail below. Furthermore, a human-machine interface (HMI) 140 is provided with which a user of the vehicle sound processing system 100 such as a driver or any other vehicle occupant can control the sound processing system.

FIG. 2 furthermore shows schematically the array of external microphones 20, in which a number of N microphones may be provided. Furthermore, an array of loudspeakers 30 is schematically shown which is used to output the sound field generated by the processing unit 120. The loudspeakers 30 may be implemented as a surround sound system, such as a 5.1 system. The loudspeakers 30 and the number of loudspeakers are designed such that a sound can be output by the loudspeakers 30 which is in a three-dimensional sound field. The processing unit 120 is configured to perform acoustic scene analysis, interpretation, and clustering of the sounds as will be described in more detail below. Furthermore, the processing unit 120 is able to decide which sound events occurring outside the vehicle 10 is included in the three-dimensional sound field to be output to the vehicle occupant.

Figure 3:
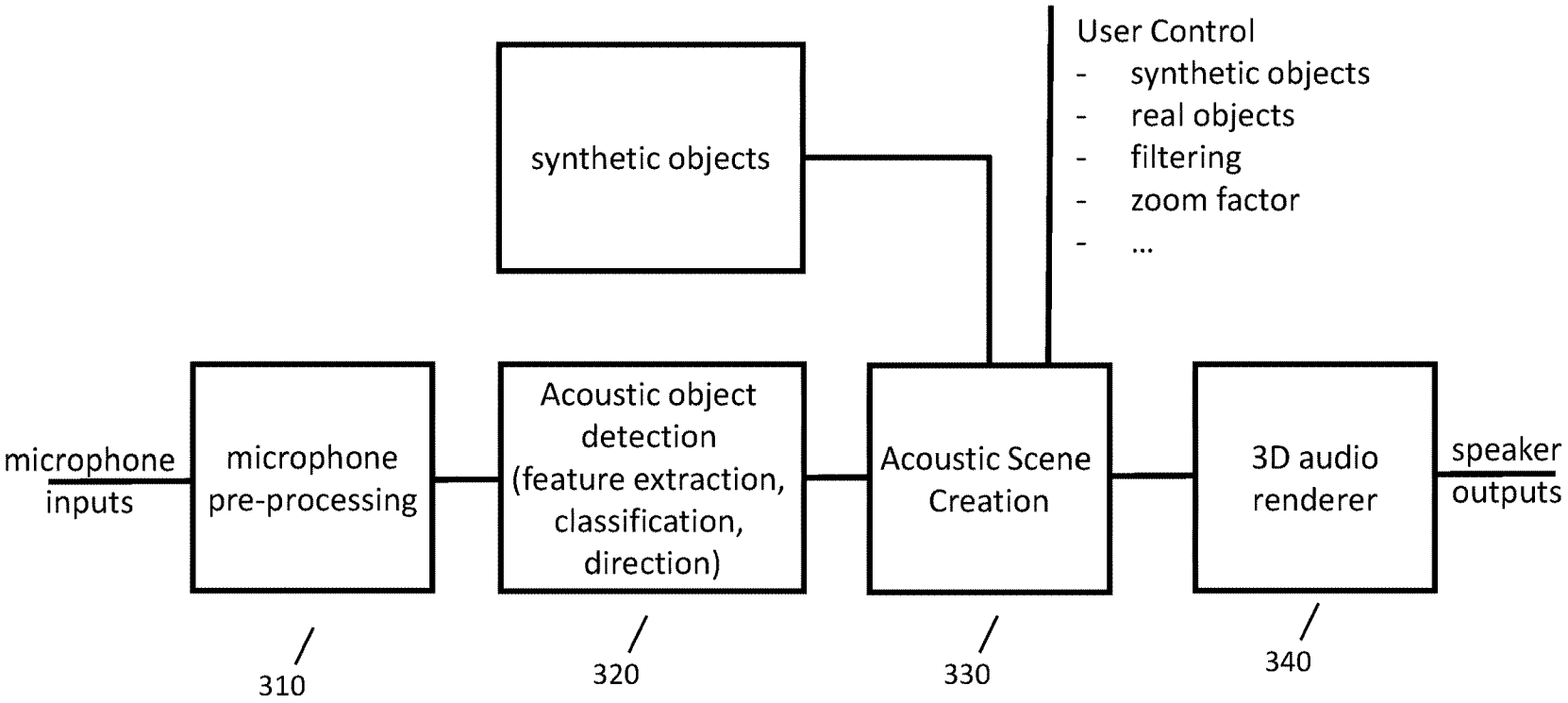
FIG. 3 shows a schematic representation of processing steps carried out on the signals detected by the sensor array of FIG. 1 in order to generate the three-dimensional sound field.

FIG. 3 shows a more detailed view of the processing steps carried out on the signals detected by the array of sensors 20. In the following, it is assumed that an array of microphones 20 is used which detects audio signals. The outside microphone array 20 detects the complete outside noise and sounds. A pre-processing module 310 filters the input signals so that the higher level processing blocks can work on it. By way of example, noise is detected and extracted from the signal, for example, the noise occurring when the microphones detect sound in a moving environment. An object detection block 320 is provided, the signal features of the detected sound are extracted and classified into certain acoustic objects, such as other vehicles, a vehicle with a siren, etc. In this context, an acoustic scene analysis is carried out. The acoustic scene analysis comprises the steps of carrying out a spatial analysis and a content analysis. Different options to carry out the spatial analysis are known in the art. By way of example, one possible implementation is described by Keisuke Imoto and Nobutaka Ono in "SPATIAL-FEATURE-BASED ACOUSTIC SCENE ANALYSIS USING DISTRIBUTED MICROPHONE ARRAY" 23$^{rd}$ EUSIPCO. A possible implementation of the content analysis is described in "LARGE-SCLAE AUDIO FEATURE EXTRACTION AND SVM FOR ACOUSTIC SCENE CLASIFICATION" FROM J. T. Geiger et al. in 2013 IEEE Workshop on Applications of Signal Processing to Audio and Acoustics, Oct. 20-23, 2013. Furthermore, a position detection is carried out in block 320 where the different objects identified by the object detection are localized and tracked. For each detected object, a precise and unique location in space (e.g., an x, y, z position) is determined. The next functional block 330 is a block configured to generate an acoustic scene where the objects detected by the array of microphones can be combined with any other virtual or synthetic object the user wants to place in the sound field to be output by the loudspeakers 30. The user can use the human-machine interface 140 to add a virtual sound object. In this context, different options are possible. By way of example, when the array of sensors 30 additionally comprises image sensors and the image sensors detect an object in the vehicle environment which may be hazardous to the vehicle, a virtual sound object may be placed in the three-dimensional sound field even though the object outside the vehicle does not generate a sound. By way of example, the object may be a child located in front of the vehicle 10 who intends to cross the road in front of the vehicle 10 or the object may be any other object such as a stone or piece of wood located on the road and which may be hazardous for the vehicle 10. In this context, the object is a virtual object detected by a sensor outside the vehicle 10, but which does not generate a sound or does not generate a sound level high enough so that the vehicle occupant pays attention to the detected object. Furthermore, it is possible that the virtual object is an object not detected by any of the sensors which monitor the vehicle environment, but may be an object such as another person with whom the vehicle occupant is currently speaking over the phone. The sound processing system 100 can detect via the input/output unit 110 receiving signals from a vehicle network with which the system 100 is informed that a voice call is going on in the vehicle 10. The person at the other end of the line may be placed in the three-dimensional sound field at a predefined position or at a position input by the vehicle occupant using the human-machine interface 140 so that the voice is perceived by the vehicle occupant as originating from a certain location defined by the user.

When image sensors are used for detecting the signals outside the vehicle, the modules 310 and 320 can include image post processing techniques via which objects can be detected together with their position in space. Depending on the fact whether the image sensors are used in addition or instead of the microphones, the modules for image post processing are provided in addition to modules 310 and 320 or instead of these modules.

When the positions of the different objects to be located in the sound field are known, the 3-D sound field can be generated based on known techniques such as Ambisonics or wave field synthesis.

Summarizing, during the generation of the three-dimensional sound field by the acoustic scene creation module 330, real objects detected outside the vehicle 10 and virtual objects are combined to a hybrid world. Additionally, a zoom function is provided with which a location of a real object or of a virtual object can be amended. By way of example, the array of microphones 30 may have detected a siren of an emergency vehicle and the position of this emergency vehicle may be detected based on the signals detected by the different microphones 20. This object is then located at a virtual location in the three-dimensional sound field such that when the three-dimensional sound field is output to the user, the user locates the sound event at the determined location. The zoom function now provides the possibility to increase or decrease the distance of the virtual location of the sound event relative to the vehicle occupant. By way of example, if the driver should be alerted of a certain object outside the vehicle 10, the distance can be decreased so that the driver has the impression that the object is located closer to the vehicle 10 than it is located in reality. The zoom function may be adapted by a vehicle occupant using the human-machine interface 140. By way of example, the user can determine that a certain group of objects or any object considered as a hazardous object for the vehicle should be located in the three-dimensional sound field closer than in reality, for example, 10%, 20% or any other percentage or absolute distance closer to the vehicle than in reality. Finally, a three-dimensional audio rendering module 340 is provided which generates the three-dimensional sound field. The signal output by module 340 can be output to the vehicle speakers 30.

The memory 130 can furthermore store certain sound files representing different objects to be located in the three-dimensional sound field. By way of example, a sound file may be provided outputting a sound as generated by children when playing. This sound file may then be used and placed at a desired location in the three-dimensional sound field in order to alert the driver that a child is detected outside the vehicle at a certain location even though no sound was detected from the child. Other sound files may be stored in the memory 130 which could be used by the sound processing system 100 in order to locate certain objects within the sound field.

Figure 4:
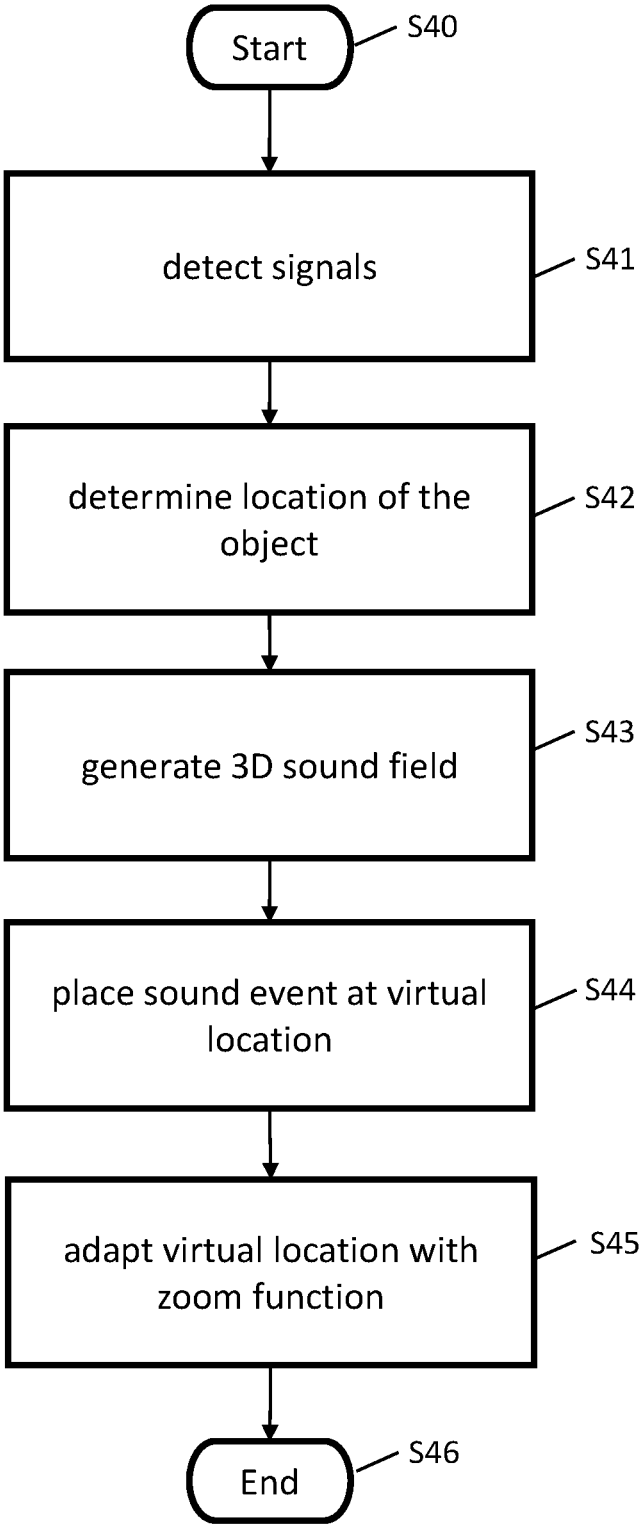
FIG. 4 shows an example flowchart of a method carried out by the vehicle sound processing system shown in FIG. 2 to draw the attention of the vehicle occupant to a certain event outside the vehicle.

FIG. 4 summarizes some of the steps carried out by the sound processing system 100 discussed above in connection with FIGS. 2 and 3. The method starts in step S40 and in step S41 signals outside the vehicle 10 are detected. The detected signals may comprise audio signals detected by an array of microphones 30. In addition or as an alternative, the detected signals may contain image signals detected by an array of image sensors 30. After some pre-processing discussed above and not shown in FIG. 4, at step S42 the location of at least one object is determined based on the detected signals. When the signal comprises audio signals, methods such as beam forming may be used to localize the object in space. When the signals comprise image signals image post processing algorithms known in the art may be used to identify objects and the corresponding location in space. For each object detected a precise location in the space outside the vehicle is determined. When all the objects are located at a desired location, it is determined which objects should be included in the sound field and a three-dimensional sound field can be generated in step S43 which reflects the different objects to be included in the sound field and for which a location was determined in step S42. In this step, only predefined sound events (e.g. sirens) may be included in the sound fields to be output to the vehicle occupant. In another option, the system 100 can be configured such that all the objects detected by the microphones 30 are included in the sound field and are output to the vehicle cabin without removing any object or without removing any sound components (expect noise) from the detected sound signal and without attenuating the detected sound signals. Accordingly, the vehicle occupant has the impression to be located outside the vehicle 10 where the sound signals are not attenuated by the vehicle cabin.

The three-dimensional sound field is generated such that the user has the impression that the sound comes from a point in space where the object was actually located in real world. Different options for determining the 3 dimensional sound field were discussed above. Furthermore, it is also known, that a sound generated in space creates a sound wave which propagates to the ears of the vehicle occupant. The signals arriving at both ears are also subject to a filtering process caused by the interaction with the body of the vehicle occupant. The transformation of a sound from a defined location in space to the ear canal can be measured accurately using Head-Related Transfer Functions (HRTF). As known in the art, for the generation of a three-dimensional sound field, mimicking of the natural hearing is carried out. Furthermore, the generation of a three-dimensional sound field combines the determined location with distance, motion or ambience cues so that a complete simulation of a scene can be generated. In step S44, the sound event is placed at a virtual location in the 3D sound field which is determined such that the user has the impression to hear the sound event from the detected location.

Additionally, each of the sound events to be output is placed at a desired virtual location which, when translated into the three-dimensional sound field, corresponds to the location where the user expects to hear an object located in the real world at a defined location. Finally, in step S45 it is determined which zoom function is used to move one of the objects closer to or further away from the vehicle. With the zoom function, the virtual location in the three-dimensional sound field is adapted such that the user perceives the sound as coming from a location closer to the user than in reality. In another embodiment, the distance of the virtual location may also be increased so that the listener perceives the object from a point in space which is located further away than in reality. The method ends in step S46.

Figure 5:
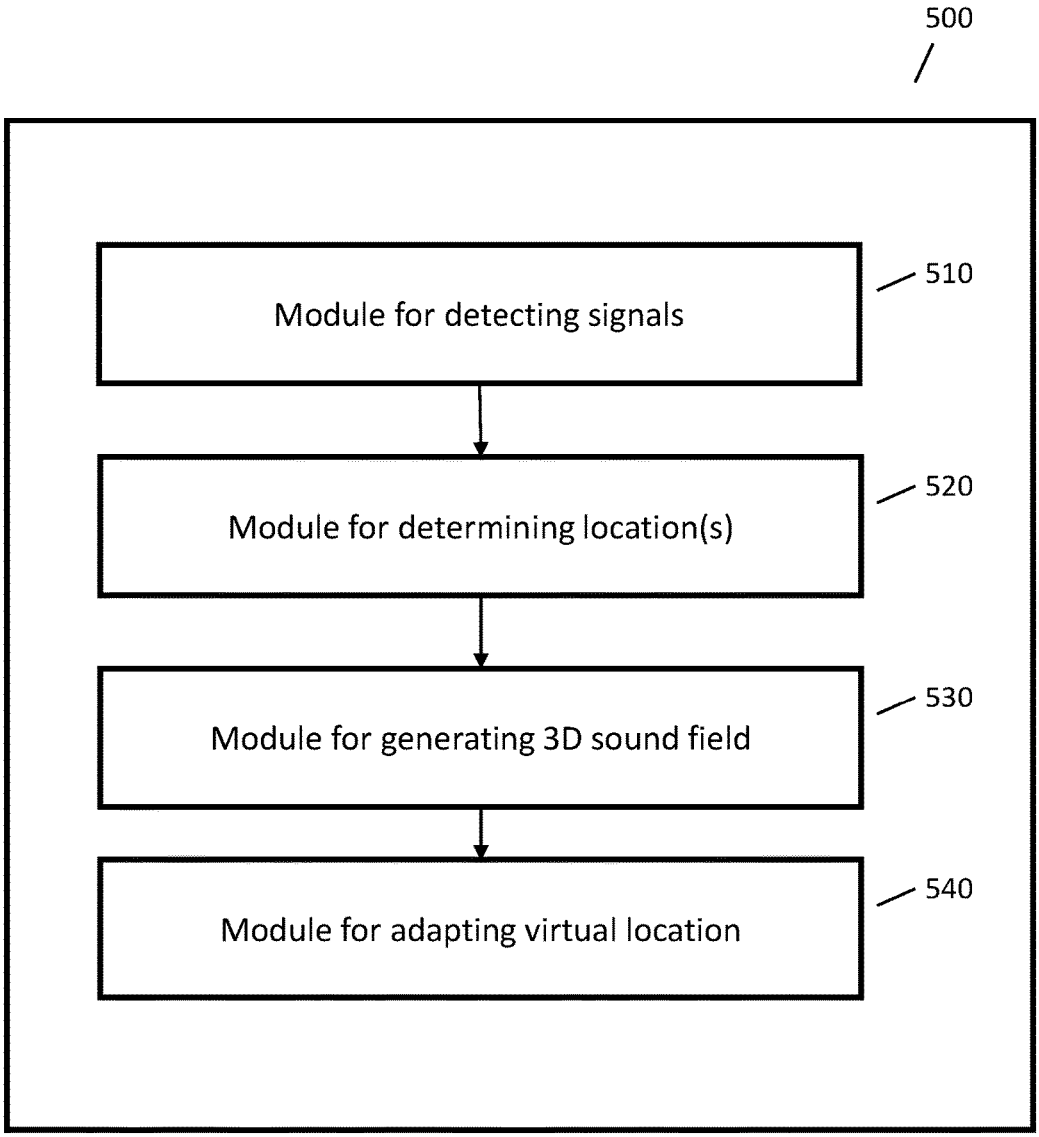
FIG. 5 shows another schematic representation of a vehicle sound processing system configured to draw the attention of a vehicle occupant to a certain event outside the vehicle.

FIG. 5 shows another schematic representation of a further vehicle's sound processing system. The system 500 comprises a module 510 for detecting the signals of the objects located outside the vehicle 10. Additionally, a module 520 is provided with which the locations of the different objects determined by module 510 are determined. A module 530 is provided which generates the sound field in three-dimensional space and which places the sound events in the three-dimensional sound field at locations as discussed above. Additionally, a module 540 is provided with which the virtual location of a sound event can be decreased or increased. As discussed above, with this module it is possible to move an object in the listener's impression closer to the vehicle 10 than in the real world.

From the above, some general conclusions can be drawn:

The sound processing system can comprise an interface operable by the vehicle occupant and with which the three-dimensional sound field and the sound event can be adapted. The interface or human-machine interface 140 provides the possibility to the vehicle occupant to amend the distance provided by the zoom function. When it is detected that the position of the virtual location has been amended, either by the processing unit 120 or by the user, the processing unit 120 is configured to determine a new virtual location of the sound event and is configured to place the sound event in the three-dimensional sound field at the new virtual location.

Using the interface, the vehicle occupant can move an object detected outside the vehicle 10 in the hearing impression closer to the vehicle compared to the real position of the object outside the vehicle. Furthermore, it is possible to use the interface to place at least one virtual sound event not detected by the array of sensors in the three-dimensional sound field at a defined location, wherein, when it is detected that the virtual sound event is placed at the defined location, the three-dimensional sound field is generated such that it includes the at least one virtual sound event at the defined location.

The array of sensors 30 can comprise an array of microphones, an array of image detectors or both or any other array of sensors allowing a position of an object located outside the vehicle to be determined.

When the array of sensors 30 comprising an array of microphones detects a plurality of sound events outside the vehicle 10, the processing unit 120 can be configured such that the plurality of sound events are identified and filtered in such a way that only predefined sound events are represented in the three-dimensional sound field. This means that some of the identified signals are not transmitted by the module 320 of FIG. 3 where the different sound events are classified. By way of example, the system, or especially module 320 can filter out all signals except sounds generated by emergency vehicles, such as a siren. Furthermore, sound signals louder than a predefined threshold may also be transmitted to the other processing modules and included in the three-dimensional sound field. Additionally, the user can control the sound events not filtered out by the system 100 by indicating sound events which should be included in the three-dimensional sound field.

Furthermore, the vehicle sound processing system 100 is able to include an object which does not generate sound into the three-dimensional sound field. When the location of an object outside the vehicle 10 is determined, for example, based on image data such as an object on the road or a child on or next to the road, a virtual sound event may be generated which represents the object detected by the image sensor. Moreover, a position of the virtual sound event is determined in the three-dimensional sound field based on the determined location and the virtual sound event is placed in the three-dimensional sound field at the determined position. The sound generated by the sound event may be stored in a predefined sound file or may be generated by the processing unit 120. By way of example, an alarm signal may be generated such that the vehicle occupant perceives the sound as originating from the location where the object is detected.

Furthermore, it is possible that the array of microphones detects environment signals from a complete vehicle environment comprising a plurality of different objects, wherein the plurality of objects are all placed in the 3 dimensional sound field without filtering out any of the plurality of different objects and without attenuating the sound signals emitted by the plurality of different objects. Here, the vehicle occupant has the impression to sit outside the vehicle 10 and to hear the ambient sound without attenuation by the vehicle cabin.

Summarizing, the disclosed techniques enable an intuitive way to inform a user of an object located outside the vehicle 10. By controlling the distance of the object in the three-dimensional sound field and thus the perception of the user, the vehicle occupant, especially the driver, can be informed in an effective way of possible hazardous situations and objects detected outside the vehicle 10.

Aspects of the examples described above may be embodied as a system, method or computer program product. Any combination of one or more computer readable media may be utilized. The computer readable medium may be a computer readable signal medium or a computer readable storage medium. A computer readable storage medium may be an electronic, magnetic, optical, electromagnetic, infrared or a semiconductor system apparatus or device, or any suitable combination of the foregoing. More specific examples of the computer readable storage medium can include an electric connection having one or more wires, a portable computer diskette, a hard disk, a random access memory, a read-only memory, an erasable programmable read-only memory, an optical fiber, a CD ROM, an optical storage device, or any tangible medium that can contain or store a program for use with an instruction execution system.

The above discussed flowchart or block diagrams illustrate the architecture, functionality and operation of possible implementations of systems, methods and computer program products according to various examples of the present application. Each block in the flowchart or block diagram may represent a module, segment or portion of code which comprises one or more executable instructions for implementing the specified logical function.

What is claimed is:

1. A vehicle sound processing system comprising an array of sensors configured to detect signals of an object located outside of a vehicle;

a memory configured to store control instructions; and a processing unit connected to the array of sensors and configured to read the control instructions from the memory and to perform, based on the control instructions; the steps of:

determining a location of the object outside the vehicle based on the detected signals;

generating a three-dimensional sound field inside the vehicle and placing a sound event representing the detected object in the three-dimensional sound field at a virtual location in the three-dimensional sound field such that when the three-dimensional sound field with the sound event is output to a vehicle occupant, the vehicle occupant locates the sound event at the determined location of the object, and providing a zoom function with which a distance of the virtual location of the sound event relative to the vehicle occupant is decreased or increased.

2. The vehicle sound processing system according to claim 1, further comprising an interface operable by the vehicle occupant with which the three-dimensional sound field and the sound event can be adapted.

3. The vehicle sound processing system according to claim 2, wherein the interface is further operable to amend the distance provided by the zoom function, wherein upon detecting that the distance of the virtual location has been amended, the processing unit is configured to determine a new virtual location of the sound event and to place the sound event in the three-dimensional sound field at the new virtual location.

4. The vehicle sound processing system according to claim 2, wherein the interface is further operable to place at least one virtual sound event not detected by the array of sensors in the three-dimensional sound field at a defined location, wherein upon detecting that the at least one virtual sound event is placed at the defined location, the processing unit is configured to generate the three-dimensional sound field including the at least one virtual sound event at the defined location.

5. The vehicle sound processing system according to claim 1, wherein the array of sensors comprises at least one of an array of microphones and an array of image detectors.

6. The vehicle sound processing system according to claim 1, wherein the array of sensors comprises an array of microphones configured to detect a plurality of sound events outside the vehicle, the processing unit being configured to identify the plurality of sound events and to filter the plurality of sound events in such a way that only predefined sound events are represented in the three-dimensional sound field.

7. The vehicle sound processing system according to claim 1, further comprising at least one image sensor, wherein the processing unit is configured to:

determine the location of the object outside the vehicle based on image data generated by the at least one image sensor, generate a virtual sound event representing the object detected by the image sensor, determine a position of the virtual sound event in the three-dimensional sound field based on the determined location, and place the virtual sound event in the three-dimensional sound field at the determined position.

8. A method for generating a three-dimensional sound field, comprising the steps of:

detecting signals of an object located outside of a vehicle with an array of sensors;

determining a location of the object outside the vehicle based on detected signals;

generating a three-dimensional sound field inside the vehicle and placing a sound event representing the detected object in the three-dimensional sound field at a virtual location in the three-dimensional sound field such that when the three-dimensional sound field with the sound event is output to a vehicle occupant, the vehicle occupant locates the sound event at the determined location of the object; and activating a zoom function with which a distance of the virtual location of the sound event relative to the vehicle occupant is decreased or increased.

9. The method according to claim 8, further providing an interface operable by the vehicle occupant with which the three-dimensional sound field and the sound event can be adapted wherein upon detecting that the distance of the virtual location has been amended, a new virtual location of the sound event is determined and the sound event is placed in the three-dimensional sound field at the new virtual location.

10. The method according to claim 9, wherein the distance of the virtual location is adapted based on an input of the vehicle occupant.

11. The method according to claim 8, further comprising the step of placing at least one virtual sound object which was not detected by the array of sensors in the three-dimensional sound field at a defined location based on an input of the vehicle occupant, wherein upon detecting that the at least one virtual sound event is placed at the defined location, the three-dimensional sound field is generated including the at least one virtual sound event at the defined location.

12. The method according to claim 8, wherein a plurality of sound events is detected outside the vehicle by an array of microphones and the plurality of sound events are identified and filtered in such a way that only predefined sound events are represented in the three-dimensional sound field.

13. The method according to claim 8, comprising the steps of:

determining the location of the object outside the vehicle based on image data generated by at least one image sensor, generating a virtual sound event representing the object detected by the image sensor, determining a position of the virtual sound event in the three-dimensional sound field based on the determined location, and placing the virtual sound event in the three-dimensional sound field at the determined position.

14. The method according to claim 8, wherein the array of microphones detects environment signals from a complete vehicle environment comprising a plurality of different objects, wherein the plurality of objects is placed in the three-dimensional sound field without filtering out any of the plurality of different objects and without attenuating sound signals emitted by the plurality of different objects.

15. A computer program comprising program code to be executed by at least one processor of a vehicle sound processing system, wherein execution of the program code causes the at least one processor to execute the method according to claim 8.

16. A vehicle sound processing system comprising a memory including program code; and a processing unit connected to the memory to execute the program code to:

determine a location of an object outside of a vehicle based on signals provided by an array of sensors;

provide a sound event representing the detected object in a three-dimensional sound field at a virtual location in the three-dimensional sound field;

provide a three-dimensional sound field inside the vehicle to a vehicle occupant to locate the sound event at the determined location of the object; and provide a zoom function with which a distance of the virtual location of the sound event relative to the vehicle occupant is decreased or increased.

17. The vehicle sound processing system of claim 16, further comprising an interface operable by the vehicle occupant with which the three-dimensional sound field and the sound event can be adapted.

18. The vehicle sound processing system of claim 17, wherein the interface is further operable to amend the distance provided by the zoom function, wherein upon detecting that the distance of the virtual location has been amended, the processing unit is configured to determine a new virtual location of the sound event and to place the sound event in the three-dimensional sound field at the new virtual location.

19. The vehicle sound processing system of claim 17, wherein the interface is further operable to place at least one virtual sound event not detected by the array of sensors in the three-dimensional sound field at a defined location, wherein upon detecting that the virtual sound event is placed at the defined location, the processing unit is configured to generate the three-dimensional sound field including the at least one virtual sound event at the defined location.

20. The vehicle sound processing system of claim 17, further comprising at least one image sensor, wherein the processing unit is configured to:

determine the location of the object outside the vehicle based on image data generated by the at least one image sensor, generate a virtual sound event representing the object detected by the image sensor, determine a position of the virtual sound event in the three-dimensional sound field based on the determined location, and place the virtual sound event in the three-dimensional sound field at the determined position.

* * * * *